US010301793B2

(12) United States Patent
Hijikata et al.

(10) Patent No.: US 10,301,793 B2
(45) Date of Patent: May 28, 2019

(54) HYDRAULIC DRIVE SYSTEM FOR WORK MACHINE

(71) Applicant: Hitachi Construction Machinery Co., Ltd., Taito-ku, Tokyo (JP)

(72) Inventors: Seiji Hijikata, Tsukuba (JP); Kouji Ishikawa, Kasumigaura (JP); Takatoshi Ooki, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 39 days.

(21) Appl. No.: 15/516,089

(22) PCT Filed: Oct. 2, 2014

(86) PCT No.: PCT/JP2014/076470

§ 371 (c)(1),
(2) Date: Mar. 31, 2017

(87) PCT Pub. No.: WO2016/051579

PCT Pub. Date: Apr. 7, 2016

(65) Prior Publication Data

US 2017/0298590 A1 Oct. 19, 2017

(51) Int. Cl.
*E02F 9/22* (2006.01)
*E02F 3/42* (2006.01)
(Continued)

(52) U.S. Cl.
CPC ..... *E02F 3/425* (2013.01); *E02F 9/22* (2013.01); *E02F 9/2217* (2013.01);
(Continued)

(58) Field of Classification Search
CPC . E02F 3/425; E02F 9/2217; E02F 9/22; E02F 9/2225; E02F 9/2271; E02F 9/2296; F15B 21/14; F15B 11/16
See application file for complete search history.

(56) References Cited

U.S. PATENT DOCUMENTS 9,394,671 B2 * 7/2016 Hirozawa ..... E02F 9/2217
2007/0186548 A1 8/2007 Smith et al.
(Continued)

FOREIGN PATENT DOCUMENTS

JP 2010-190261 A 9/2010
JP 2013-204223 A 10/2013
WO WO 2013/145528 A1 10/2013

OTHER PUBLICATIONS

International Search Report (PCT/ISA/210) issued in PCT Application No. PCT/JP2014/076470 dated Dec. 22, 2014 with English-language translation (three (3) pages).
(Continued)

*Primary Examiner* — Abiy Teka
(74) *Attorney, Agent, or Firm* — Crowell & Moring LLP

(57) ABSTRACT

When hydraulic fluid discharged from a hydraulic actuator is to be recovered for driving a different hydraulic actuator, the recovery frequency is increased to achieve further energy saving. To this end, a pressure increasing circuit 36 is provided in which a communication pressure increasing valve 12 is disposed in a communication passage 26 that connects a bottom side line 23 of and a rod side line 24 a boom cylinder 4. A recovery control valve 11 is controlled such that, when a first operation unit 5 is operated in a boom lowering direction (own weight falling direction of the boom) and a second operation unit 6 is operated simultaneously, only if the pressure at the bottom side of the boom cylinder 4 is higher than the pressure at the arm cylinder side that is a recovery destination of hydraulic fluid, the recovery
(Continued)

control valve 11 is opened to recover the flow rate discharged from the bottom side of the boom cylinder 4 to the arm cylinder side.

5 Claims, 7 Drawing Sheets

(51) Int. Cl.
*F15B 21/14* (2006.01)
*F15B 11/16* (2006.01)
*E02F 3/32* (2006.01)

(52) U.S. Cl.
CPC ..... *E02F 9/2225* (2013.01); *E02F 9/2271* (2013.01); *E02F 9/2296* (2013.01); *F15B 11/16* (2013.01); *F15B 21/14* (2013.01); *E02F 3/32* (2013.01); *E02F 9/2285* (2013.01); *E02F 9/2292* (2013.01); *F15B 2211/20546* (2013.01); *F15B 2211/46* (2013.01); *F15B 2211/6313* (2013.01); *F15B 2211/6326* (2013.01); *F15B 2211/6336* (2013.01); *F15B 2211/6346* (2013.01); *F15B 2211/7053* (2013.01); *F15B 2211/71* (2013.01); *F15B 2211/88* (2013.01)

(56) References Cited

U.S. PATENT DOCUMENTS

2012/0180470 A1 7/2012 Schroeder et al.
2015/0066313 A1 3/2015 Hirozawa et al.

OTHER PUBLICATIONS

Japanese-language Written Opinion (PCT/ISA/237) issued in PCT Application No. PCT/JP2014/076470 dated Dec. 22, 2014 (three (3) pages).
International Preliminary Report on Patentability (PCT/IB/338 & PCT/IB/373) issued in PCT Application No. PCT/jP2014/076470, including English translation of Written Opinion (PCT/ISA/237) dated Apr. 13, 2017 (six (6) pages).
Extended European Search Report issued in counterpart European Application No. 14902957.1 dated May 29, 2018 (eight (8) pages).

* cited by examiner

HYDRAULIC DRIVE SYSTEM FOR WORK MACHINE

TECHNICAL FIELD

The present invention relates to a hydraulic drive system for a work machine, and particularly to a hydraulic drive system for a work machine such as a hydraulic excavator that includes a recovery circuit that reutilizes (recovers) hydraulic fluid discharged from a hydraulic actuator by inertial energy of a driven member (for example, a boom) such as own weight falling of the driven member for driving a different hydraulic actuator.

BACKGROUND ART

A hydraulic drive system for a work machine including a recovery circuit for reutilizing (recovering) hydraulic fluid discharged from a boom cylinder by own weight falling of a boom for driving an arm cylinder is known, and an example of the hydraulic drive system is disclosed in Patent Document 1. In the hydraulic drive system of Patent Document 1, when discharged fluid from a boom cylinder is to be recovered to an arm cylinder, the delivery flow rate of a hydraulic pump that supplies hydraulic fluid to the arm cylinder is decreased as much to achieve improvement of the fuel cost of an engine.

PRIOR ART DOCUMENT

Patent Document

Patent Document 1: JP-2010-190261-A

SUMMARY OF THE INVENTION

Problem to be Solved by the Invention

In the hydraulic drive system of Patent Document 1, since the delivery flow rate of a hydraulic pump is decreased to achieve improvement of the fuel cost by an amount of recovered hydraulic fluid from the boom cylinder to the arm cylinder, energy saving can be achieved.

However, normally in a series of excavation work, the pressure at the bottom side of the boom cylinder is frequently lower than the delivery pressure of the hydraulic pump that supplies hydraulic fluid to the arm cylinder or the load pressure of the arm cylinder. Further, from the nature of fluid that it flows from a location at which the pressure is high to another location at which the pressure is low, actually the frequency in which recovery is performed is low. Therefore, it is difficult to achieve sufficient energy saving.

It is an object of the present invention to provide a hydraulic drive system for a work machine in which, when hydraulic fluid discharged from a hydraulic actuator is to be recovered for driving a different hydraulic actuator, the recovery frequency can be increased to achieve further energy saving.

Means for Solving the Problem (1) To achieve the object described above, according to the present invention, there is provided a hydraulic drive system for a work machine that includes a hydraulic pump unit, a first hydraulic actuator to which hydraulic fluid is supplied from the hydraulic pump unit to drive a first driven member, a second hydraulic actuator to which hydraulic fluid is supplied from the hydraulic pump unit to drive a second driven member, a first control valve configured to control a flow of hydraulic fluid to be supplied from the hydraulic pump unit to the first hydraulic actuator, a second control valve configured to control a flow of hydraulic fluid to be supplied from the hydraulic pump unit to the second hydraulic actuator, a first operation unit configured to output an operation signal for commanding an operation of the first driven member to change over the first control valve, and a second operation unit configured to output an operation signal for commanding an operation of the second driven member to change over the second control valve, in which the first hydraulic actuator is a hydraulic cylinder that discharges, when the first operation unit is operated in an own weight falling direction of the first driven member, hydraulic fluid from a bottom side by own weight falling of the first driven member and inhales hydraulic fluid from a rod side, the hydraulic drive system including a recovery circuit including a recovery passage that connects the bottom side of the hydraulic cylinder to a location between the hydraulic pump unit and the second hydraulic actuator and a recovery control valve that supplies at least part of hydraulic fluid discharged from the bottom side of the hydraulic cylinder to the location between the hydraulic pump unit and the second hydraulic actuator through the recovery passage, a pressure increasing circuit having a communication passage that connects the bottom side of the hydraulic cylinder to the rod side of the hydraulic cylinder and a communication pressure increasing valve disposed in the communication passage and configured to open in accordance with an operation signal of the first operation unit for operating the first driven member in the own weight falling direction to communicate the bottom side with the rod side of the hydraulic cylinder to increase a pressure at the bottom side of the hydraulic cylinder, and a control unit configured to open the recovery control valve, in the case where, when the first operation unit is operated in the own weight falling direction of the first driven member and the second operation unit is operated at the same time, the pressure at the bottom side of the hydraulic cylinder is higher than a pressure at the location between the hydraulic pump unit and the second hydraulic actuator, to control a flow rate of hydraulic fluid to be supplied from the bottom side of the hydraulic cylinder to the location between the hydraulic pump unit and the second hydraulic actuator.

In the invention configured in this manner, where the ratio of the rod side pressure receiving area to the bottom side pressure receiving area of the hydraulic cylinder (first hydraulic actuator) is represented by k, the pressure at the bottom side of the hydraulic cylinder (first hydraulic actuator) can be increased to approximately $1/(1-k)$ times (where the pressure receiving area ratio k is 2, to approximately two times) by the pressure increasing circuit. Consequently, the energy of hydraulic fluid recovered from the bottom side of the hydraulic cylinder to the location between the hydraulic pump unit and the second hydraulic actuator (second hydraulic actuator side) increases, and further energy saving can be anticipated.

(2) The hydraulic drive system for a work machine of (1) described above is preferably configured such that it further includes a discharge restrictor valve provided between the bottom side of the hydraulic cylinder and a tank, and the control unit is configured to control the discharge restrictor valve based on an operation amount of the first operation unit for operating the first driven member in the own weight falling direction, the pressure at the bottom side of the hydraulic cylinder and the pressure at the location between the hydraulic pump unit and the second hydraulic actuator.

By the configuration, the discharge restrictor valve is controlled to an appropriate opening, and while the flow rate discharged from the bottom side of the hydraulic cylinder is recovered to the second hydraulic actuator side, a target speed of the hydraulic cylinder (first hydraulic actuator) can be secured.

(3) The hydraulic drive system for a work machine of (2) described above is preferably configured such that the control unit is configured to calculate a target bottom flow rate to be discharged from the bottom side of the hydraulic cylinder and calculates a recoverable flow rate demanded by the second control valve based on an operation signal of the first operation unit for operating the first driven member in the own weight falling direction, sets a lower one of the target bottom flow rate and the recoverable flow rate as a target recovery flow rate, subtracts the target recovery flow rate from the target bottom flow rate to calculate a target discharge flow rate, controls the recovery control valve such that a flow rate of hydraulic fluid to be recovered to the second hydraulic actuator side coincides with the target recovery flow rate, and controls the discharge restrictor valve such that a flow rate to be returned to the tank coincides with the target discharge flow rate.

By the configuration, the recovery control valve and the discharge restrictor valve are controlled to respective appropriate openings, and while the flow rate discharged from the bottom side of the hydraulic cylinder is recovered to the second hydraulic actuator side to secure a target speed of the second hydraulic actuator, the target speed of the hydraulic cylinder (first hydraulic actuator) can be secured.

(4) The hydraulic drive system for a work machine of (1) described above is preferably configured such that the recovery control valve includes a first restrictor configured to control a flow rate of hydraulic fluid to be discharged from the bottom side of the hydraulic cylinder to the tank and a second restrictor configured to control a flow rate of hydraulic fluid to be supplied from the bottom side of the hydraulic cylinder to the location between the hydraulic pump unit and the second hydraulic actuator, and the control unit is configured to control the recovery control valve based on the operation amount of the first operation unit for operating the first driven member in the own weight falling direction, the pressure at the bottom side of the hydraulic cylinder and the pressure at the location between the hydraulic pump unit and the second hydraulic actuator.

By the configuration, both of the control for recovering part of the flow rate discharged from the bottom side of the hydraulic cylinder to the second hydraulic actuator side and the control for returning the remaining flow rate to the tank can be performed by a single valve (recovery control valve), and only one solenoid valve is necessitated to electrically control the valve. Therefore, the hydraulic drive system can be implemented with a simple configuration, and reduction of the cost and the mountability can be further improved.

(5) The hydraulic drive system for a work machine of any one of (1) to (4) described above is preferably configured such that the hydraulic pump unit includes at least one variable displacement hydraulic pump, and the control unit is configured to control, when the recovery control valve is to be opened to supply hydraulic fluid from the bottom side of the hydraulic cylinder to the location between the hydraulic pump and the second hydraulic actuator, such that the displacement of the hydraulic pump is decreased by an amount corresponding to the recovery flow rate to be supplied from the bottom side of the hydraulic cylinder to the location between the hydraulic pump and the second hydraulic actuator.

By the configuration, the second hydraulic actuator is controlled to a desired speed according to an operation signal of the second operation unit, and by reducing the delivery flow rate of the hydraulic pump is reduced by an amount corresponding to the recovery flow rate, energy saving can be anticipated.

Effect of the Invention

According to the present invention, where the rod side pressure receiving area ratio to the bottom side pressure receiving area of the hydraulic cylinder (first hydraulic actuator) is represented by k, the pressure at the bottom side of the hydraulic cylinder (first hydraulic actuator) can be increased to approximately 1/(1−k) times (where the pressure receiving area ratio k is 2, approximately two times) by the pressure increasing circuit. Consequently, the energy of hydraulic fluid recovered from the bottom side of the hydraulic cylinder to the location between the hydraulic pump unit and the second hydraulic actuator (second hydraulic actuator side) increases, and further energy saving can be anticipated.

MODES FOR CARRYING OUT THE INVENTION

In the following, embodiments of the present invention are described with reference to the drawings.

First Embodiment

Figure 1:
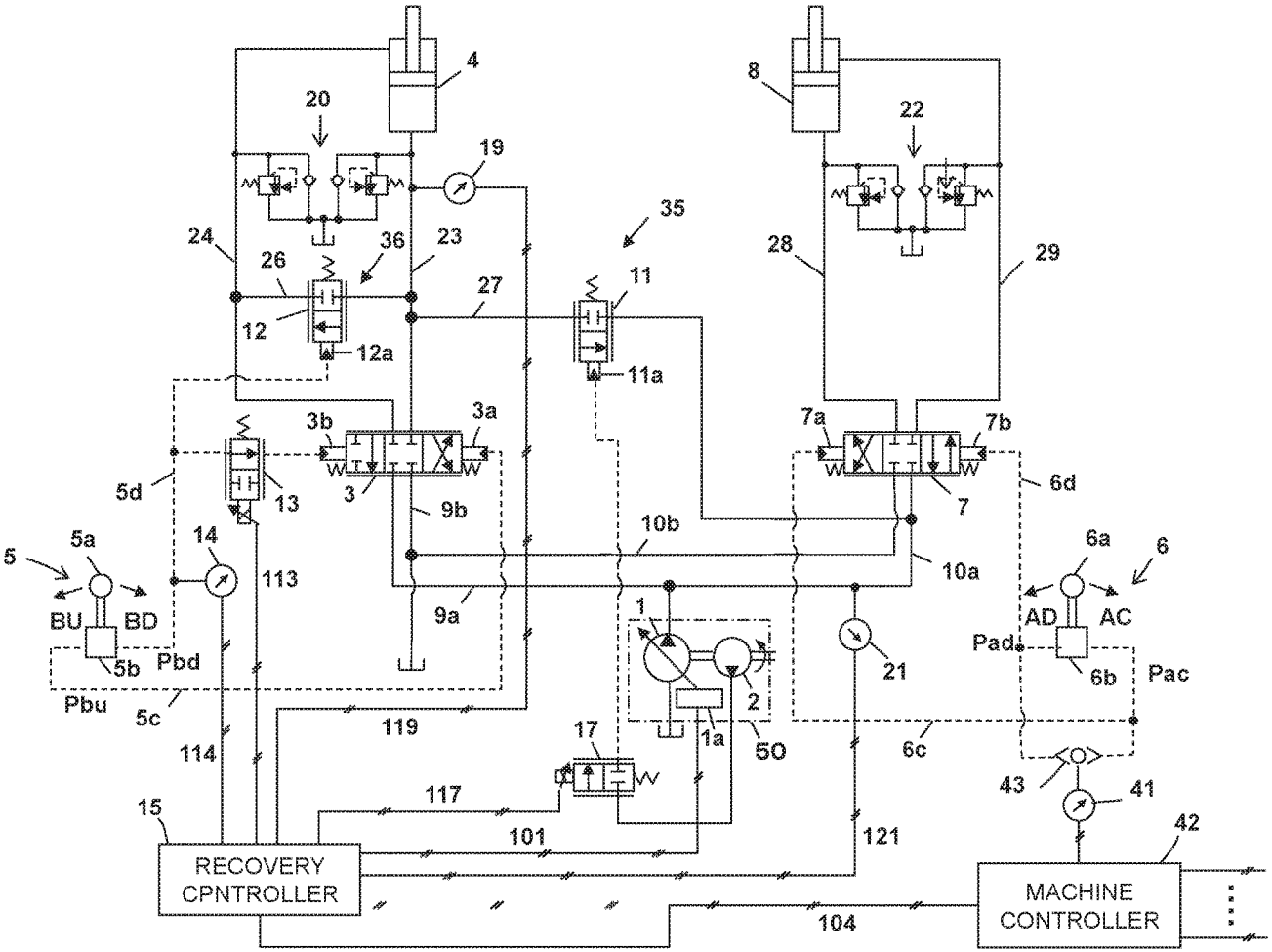
FIG. 1 is a view depicting a hydraulic drive system according to a first embodiment of the present invention.

FIG. 1 is a view depicting a hydraulic drive system according to a first embodiment of the present invention.

In FIG. 1, the hydraulic drive system of the present embodiment includes: a pump unit 50 including a main hydraulic pump 1 and a pilot pump 2; a boom cylinder 4 (first hydraulic actuator) to which hydraulic fluid is supplied from the hydraulic pump 1 to drive a boom 205 (refer to FIG. 2) of a hydraulic excavator which is a first driven member; an arm cylinder 8 (second hydraulic actuator) to which hydraulic fluid is to be supplied to drive an arm 206 (refer to FIG. 2) of the hydraulic excavator which is a second driven member; a control valve 3 (first control valve) for controlling the flow (flow rate and direction) of hydraulic fluid supplied from the hydraulic pump 1 to the boom cylinder 4; another control valve 7 (second control valve) for controlling the flow (flow rate and direction) of hydraulic fluid to be supplied from the hydraulic pump 1 to the arm cylinder 8; a first operation unit 5 for outputting an operation command for the boom to change over the control valve 3; and a second operation unit 6 for outputting an operation command for the arm to change over the control valve 7. Although the hydraulic pump 1 is connected also to a control valve not depicted such that hydraulic fluid is supplied also to a different actuator (hereinafter described) not depicted, illustration of the circuit elements is omitted.

The hydraulic pump 1 is of the variable displacement type and includes a regulator 1*a*. The regulator 1*a* is controlled by a control signal from a controller 15 (hereinafter described) to control the tilting angle (displacement) of the hydraulic pump 1 thereby to control the delivery flow rate. Further, though not depicted, the regulator 1*a* includes, as known in the art, a torque controlling unit to which a delivery pressure of the hydraulic pump 1 is introduced and which limits the tilting angle (displacement) of the hydraulic pump 1 such that the absorption torque of the hydraulic pump 1 does not exceed maximum torque determined in advance. The hydraulic pump 1 is connected to the control valves 3 and 7 through the hydraulic fluid supply lines 9*a* and 10*a* such that delivery fluid of the hydraulic pump 1 is supplied to the control valves 3 and 7, respectively.

The control valves 3 and 7 are connected to the bottom side or the rod side of the boom cylinder 4 and the arm cylinder 8 through bottom side lines 23 and 28 or rod side lines 24 and 29, respectively. Consequently, in response to the changeover positions of the control valves 3 and 7, delivery fluid of the hydraulic pump 1 is supplied from the control valves 3 and 7 to the bottom side or the rod side of the boom cylinder 4 and the arm cylinder 8 through the bottom side lines 23 and 28 or the rod side lines 24 and 29, respectively. Hydraulic fluid discharged from the boom cylinder 4 is refluxed at least at part thereof from the control valve 3 to a tank through a tank line 9*b*. Hydraulic fluid discharged from the arm cylinder 8 is refluxed at the entirety thereof from the control valve 7 to the tank through a tank line 10.

The first and second operation unit 5 and 6 have operation levers 5*a* and 6*a* and pilot valve 5*b* and 6*b*, respectively, and the pilot valve 5*b* and 6*b* are connected to operation units 3*a* and 3*b* of the control valve 3 and operation units 7*a* and 7*b* of the control valve 7 through pilot lines 5*c* and 5*d* and pilot lines 6*c* and 6*d*, respectively.

If the operation lever 5*a* is operated in the boom raising direction BU (leftward direction in the figure), then the pilot valve 5*b* generates an operation pilot pressure Pbu according to the operation amount of the operation lever 5*a*. The operation pilot pressure Pbu is transmitted to the operation unit 3*a* of the control valve 3 through the pilot line 5*c* to change over the control valve 3 to a boom raising direction (position at the right side in the figure). If the operation lever 5*a* is operated in a boom lowering direction BD (rightward direction in the figure), then the pilot valve 5*b* generates an operation pilot pressure Pbd according to the operation amount of the operation lever 5*a*. This operation pilot pressure Pbd is transmitted to the operation unit 3*b* of the control valve 3 through the pilot line 5*d* to change over the control valve 3 to a boom lowering direction (position at the left side in the figure).

If the operation lever 6*a* is operated in an arm crowding direction AC (rightward direction in the figure), then the pilot valve 6*b* generates an operation pilot pressure Pac according to the operation amount of the operation lever 6*a*. The operation pilot pressure Pac is transmitted to the operation unit 7*a* of the control valve 7 through the pilot line 6*c* to change over the control valve 7 to an arm crowding direction (position at the left side in the figure). If the operation lever 6*a* is operated in an arm dumping direction AD (leftward direction in the figure), then the pilot valve 6*b* generates an operation pilot pressure Pad according to the operation amount of the operation lever 6*a*. This operation pilot pressure Pad is transmitted to the operation unit 7*b* of the control valve 7 through the pilot line 6*d* to change over the control valve 7 to an arm dumping direction (position at the right side in the figure).

Overload relief valves 20 and 22 with makeup are connected between the bottom side line 23 and the rod side line 24 of the boom cylinder 4 and between the bottom side line 28 and the rod side line 29 of the arm cylinder 8, respectively. The overload relief valves 20 and 22 with makeup have a function of preventing the pressure in the bottom side lines 23 and 28 and the rod side lines 24 and 29 from excessively rising to damage hydraulic circuit devices and another function of decreasing such a situation that the bottom side lines 23 and 28 and the rod side lines 24 and 29 are placed into a negative pressure state to cause cavitation.

It is to be noted that, although the present embodiment is directed to a case in which the pump unit 50 includes one main pump (hydraulic pump 1), the pump unit 50 may otherwise include a plurality of (for example, two) main pumps connected to the control valves 3 and 7 such that hydraulic fluid is supplied from the different main pumps to the boom cylinder 4 and the arm cylinder 8.

Referring to FIG. 1, the hydraulic drive system of the present embodiment includes: the pump unit 50 including the main hydraulic pump 1 and the pilot pump 2; the boom cylinder 4 (first hydraulic actuator) to which hydraulic fluid is supplied from the hydraulic pump 1 to drive the boom 205 (refer to FIG. 2) of the hydraulic excavator which is a first driven member; the arm cylinder 8 (second hydraulic actuator) to which hydraulic fluid is supplied from the hydraulic pump 1 to drive the arm 206 (refer to FIG. 2) of the hydraulic excavator which is a second driven member; the control valve 3 (first control valve) for controlling the flow (flow rate and direction) of hydraulic fluid to be supplied from the hydraulic pump 1 to the boom cylinder 4; the control valve 7 (second control valve) for controlling the flow (flow rate and direction) of hydraulic fluid to be supplied from the hydraulic pump 1 to the arm cylinder 8; the first operation unit 5 that outputs an operation command for the boom to change over the control valve 3; and the second operation unit 6 for outputting an operation command for the arm to change over the control valve 7. Although the hydraulic pump 1 is connected to a control valve not depicted such that hydraulic fluid is supplied also to a different actuator (hereinafter described) not depicted, those circuit elements are omitted.

Figure 2:
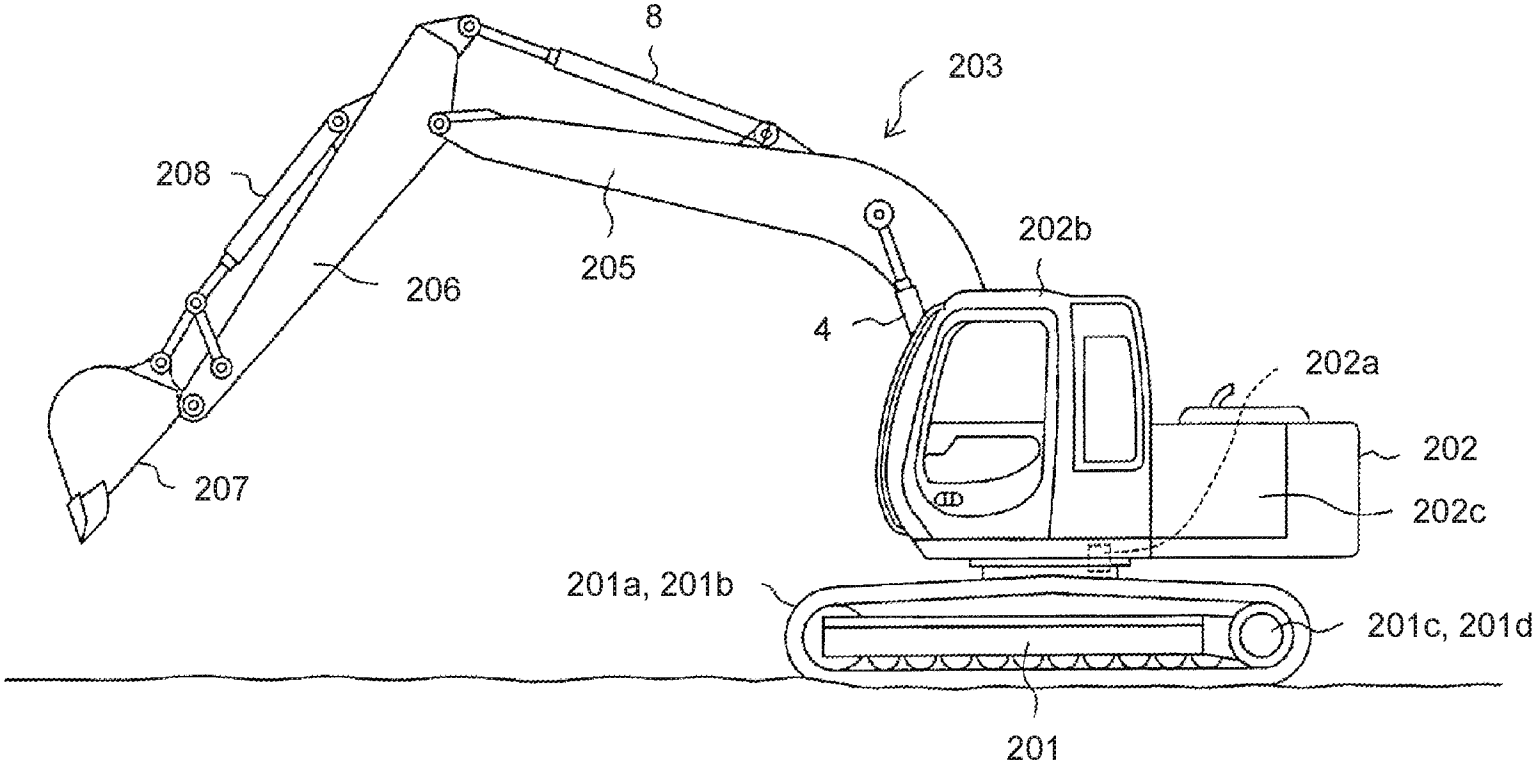
FIG. 2 is a view depicting an appearance of a hydraulic excavator that is a work machine (construction machine) in which the hydraulic drive system of the present invention is mounted.

FIG. 2 is a view depicting an appearance of a hydraulic excavator that is a work machine (construction machine) in which the hydraulic drive system according to the present embodiment is mounted.

The hydraulic excavator includes a lower track structure 201, an upper swing structure 202 and a front work implement 203. The lower track structure 201 has left and right crawler type track devices 201*a*, 201*a* (only one-side one is depicted) and is driven by left and right track motors 201*b*, 201*b* (only one-side one is depicted). The upper swing structure 202 is swingably mounted on the lower track structure 201 and is driven to swing by a swing motor 202*a*. The front work implement 203 is elevatably attached at a front portion of the upper swing structure 202. A cabin (operation room) 202*b* is provided on the upper swing structure 202, and operation unit such as the first and second operation unit 5 and 6 described above and operation pedal units for traveling not depicted are disposed in the cabin 202*b*.

The front work implement 203 has an articulated structure having the boom 205 (first driven member), the arm 206 (second driven member) and a bucket 207. The boom 205 is pivoted in the upward and downward direction with respect to the upper swing structure 202 by elongation and contraction of the boom cylinder 4. The arm 206 is pivoted in the upward and downward directions and the forward and rearward directions with respect to the boom 205 by elongation and contraction of the arm cylinder 8. The bucket 207 is pivoted in the upward and downward directions and the forward and rearward directions with respect to the arm 206 by elongation and contraction of a bucket cylinder 208.

In FIG. 1, circuit elements relating to hydraulic actuators such as the left and right track motors 201*b*, 201*b*, swing motor 202*a* and bucket cylinder 208 are omitted.

Here, the boom cylinder 4 is a hydraulic cylinder that, when the operation lever 5*a* of the first operation unit 5 is operated in the boom lowering direction (own weight falling direction of the first driven member) BD, discharges hydraulic fluid from the bottom side and inhales hydraulic fluid from the rod side by own weight falling based on the weight of the front work implement 203 including the boom 205.

Referring back to FIG. 1, the hydraulic drive system of the present invention includes, in addition to the components described above, a recovery circuit 35, a pressure increasing circuit 36, solenoid proportional valves 13 and 17, pressure sensors 14, 19, 21 and 41, a recovery controller 16 and a machine controller 42. The recovery circuit 35 has a recovery passage 27 that branches from the bottom side line 23 of the boom cylinder 4 and connects the bottom side line 23 to the hydraulic fluid supply line 10*a* of the arm cylinder 8 side, and a recovery control valve 11 disposed in the recovery passage 27, capable of adjusting the flow rate of hydraulic fluid and configured to supply at least part of hydraulic fluid discharged from the bottom side of the boom cylinder 4 to the hydraulic fluid supply line 10*a* at the arm cylinder 8 side. The pressure increasing circuit 36 includes a communication passage 26 and a communication pressure increasing valve 12. The communication passage 26 branches from the bottom side line 23 and the rod side line 24 of the boom cylinder 4 and connects the bottom side line 23 and the rod side line 24 to each other. The pressure increasing circuit 36 is disposed in the communication passage 26 and is opened on the basis of the operation pilot pressure Pbd (operation signal) in the boom lowering direction BD of the first operation unit 5 to recover and supply part of discharged fluid at the bottom side of the boom cylinder 4 to the rod side of the boom cylinder 4 and communicate the bottom side of the boom cylinder 4 with the rod side to increase the pressure at the bottom side of the boom cylinder 4 (pressure in the bottom side line 23).

The communication pressure increasing valve 12 has an operation unit 12*a* and is opened when the operation pilot pressure Pbd in the boom lowering direction BD of the first operation unit 5 is transmitted to the operation unit 12*a*.

Figure 3:
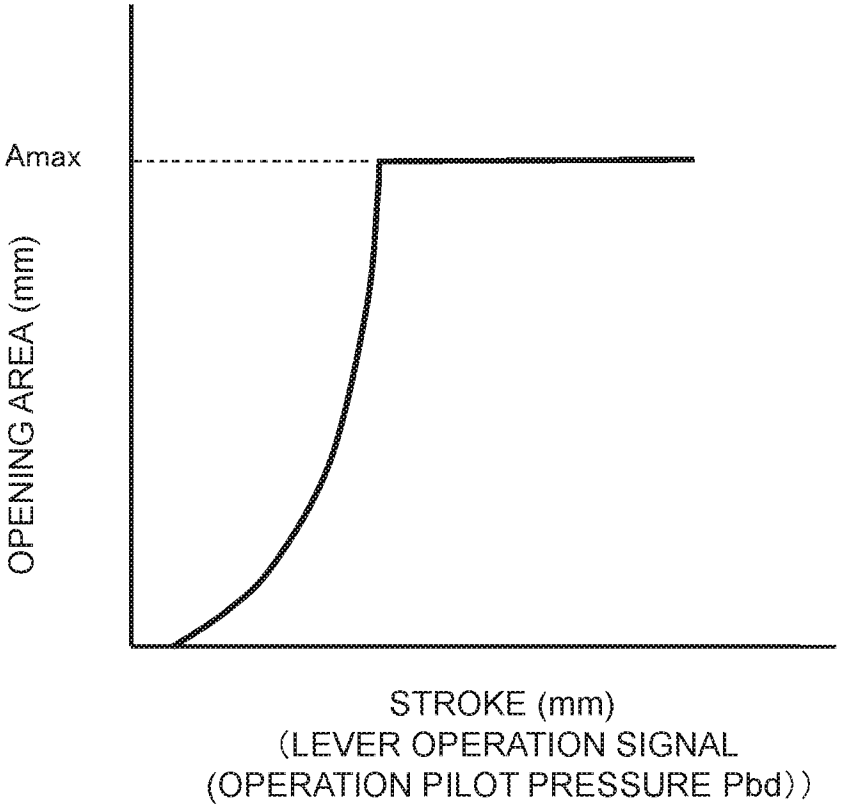
FIG. 3 is a view illustrating an opening area characteristic of a communication pressure increasing valve.

FIG. 3 is a view depicting an opening area characteristic of the communication pressure increasing valve 12. The opening area characteristic is set such that, when the operation lever 5*a* of the first operation unit 5 is operated in the boom lowering direction BD and the operation pilot pressure (lever operation signal) Pbd increases, the opening area of the communication pressure increasing valve 12 increases to a maximum opening area Amax rapidly and besides the increase of the flow rate is smooth and a shock is not caused. Further, the maximum opening area Amax when the communication pressure increasing valve 12 opens fully is set sufficiently wide such that the pressures in the bottom side line 23 and the rod side line 24 of the boom cylinder 4 when the communication pressure increasing valve 12 opens fully are substantially equal to each other. Consequently, it is possible to increase the pressure in the bottom side line 23 of the boom cylinder 4 at a magnification according to a pressure receiving area ratio between the bottom side and the rod side of the boom cylinder 4.

The pressure increase principle of the communication pressure increasing valve 12 is such as described below.

The balance in force when the boom cylinder 4 supports the boom at timings before and after opening of the communication pressure increasing valve 12 is studied. Parameters relating to the boom cylinder 4 then are represented by symbols as given below.

W: magnitude of the load of the boom and so forth supported by the boom cylinder 4 (load)

Pb1: bottom side pressure of the boom cylinder 4 before opening of the communication pressure increasing valve 12

Pr1: rod side pressure of the boom cylinder 4 before opening of the communication pressure increasing valve 12

Pb2: bottom side pressure of the boom cylinder 4 after opening of the communication pressure increasing valve 12

Pr2: rod side pressure of the boom cylinder 4 after opening of the communication pressure increasing valve 12

Ab: bottom side pressure receiving area of the boom cylinder 4

Ar: rod side pressure receiving area of the boom cylinder 4 k: ratio of the rod side pressure receiving area to the bottom side pressure receiving area of the boom cylinder 4 (pressure receiving area ratio Ar/Ab)

Further, when the boom cylinder 4 supports the load, the rod side pressure Pr1 of the boom cylinder 4 before opening of the communication pressure increasing valve 12 substantially is a tank pressure, and this tank pressure is assumed to be 0. After opening of the communication pressure increasing valve 12, the rod side pressure Pr2 becomes equal to the bottom side pressure Pb2 (Pr2≈Pb2) as described hereinabove.

The balance between the load W before opening of the communication pressure increasing valve 12 and the force of the boom cylinder 4 is represented by the following expression.

$$W = Pb1 \times Ab \tag{1}$$

Meanwhile, the balance between the load W after opening of the communication pressure increasing valve 12 and the force of the boom cylinder 4 is represented by the following expression.

$$\begin{aligned} W &= Pb2 \times Ab - Pr2 \times Ar \\ &= Pb2 \times Ab - Pb2 \times k \times Ab \\ &= Pb2 \times Ab(1-k) \end{aligned} \tag{2}$$

By transforming the expression (2) and substituting W of the expression (1), then the following expression is obtained.

$$Pb2 = W/Ab(1-k) \quad (3)$$
$$= (Pb1 \times Ab)/(Ab(1-k))$$
$$= Pb1/(1-k)$$

From the expression (3), the bottom side pressure Pb2 of the boom cylinder 4 after opening of the communication pressure increasing valve 12 is increased to 1/(1−k) times the bottom side pressure Pb1 of the boom cylinder 4 before opening of the communication pressure increasing valve 12.

In the present embodiment, the pressure receiving area ratio k of the rod side to the bottom side of the boom cylinder 4 is ½. In this case, by opening the communication pressure increasing valve 12, the pressure in the bottom side line 23 of the boom cylinder 4 can be increased to approximately two times. Further, the meter-out opening area of the control valve 3 is set supposing that, upon lowering operation of the boom cylinder 4, the pressure in the bottom side line 23 of the boom cylinder 4 is increased to approximately two times.

The pressure sensor 14 is connected to the pilot line 5*d* and detects the operation pilot pressure Pbd in the boom lowering direction BD of the first operation unit 5, and the pressure sensor 19 is connected to the bottom side line 23 of the boom cylinder 4 and detects the pressure Pb at the bottom side of the boom cylinder 4. Further, the pressure sensor 21 is connected to the hydraulic fluid supply line 10*a* at the arm cylinder 8 side and detects the delivery pressure Pp of the hydraulic pump 1. The pressure sensor 41 is connected to a shuttle valve 43 connected to the pilot lines 6*c* and 6*d* of the second operation unit 6 and detects the pressure Pa at the higher pressure side between the operation pilot pressure Pac in the arm crowding direction of the second operation unit 6 and the operation pilot pressure Pad in the arm dumping direction of the second operation unit 6 as an operation pilot pressure of the second operation unit 6.

The machine controller 42 has various functions and, as one of the functions, receives, as inputs thereto, a detection signal 114 from the pressure sensor 41 for detecting the operation pilot pressure of the second operation unit 6 and detection signals from pressure sensors for detecting the operation pilot pressures of the first operation unit 5 and other operation unit not depicted, and calculates a flow rate of hydraulic fluid necessary to drive each respective actuator as a pump demanded flow rate. When boom lowering and driving of the arm are to be performed at the same time, since it is assumed that hydraulic fluid to be supplied to the rod side of the boom cylinder 4 is covered with discharged fluid from the bottom side of the boom cylinder 4, the machine controller 42 calculates the flow rate of hydraulic fluid necessary to drive the arm cylinder 8 as a pump demanded flow rate. The machine controller 42 outputs the calculated pump demanded flow rate as a pump demanded flow rate signal 104 to the recovery controller 15.

The recovery controller 15 receives, as inputs thereto, detection signals 114, 119 and 121 from the pressure sensors 14, 19 and 21 and a pump demanded flow rate signal 104 from the machine controller 42, performs a predetermined arithmetic process on the basis of the signals and outputs control commands to the solenoid proportional valves 13 and 17 and the regulator 1*a*, respectively.

The solenoid proportional valves 13 and 17 operate in accordance with a control command from the controller 15. At this time, the solenoid proportional valve 13 reduces the operation pilot pressure Pbd in the boom lowering direction BD generated by the pilot valve 5*b* of the first operation unit 5 to a desired pressure and outputs the reduced pressure to the operation unit 3*b* of the control valve 3 to control the stroke of the control valve 3 thereby to control the opening (opening area) of the control valve 3. The solenoid proportional valve 17 converts the pressure of hydraulic fluid supplied from the pilot pump 2 into a desired pressure and outputs the hydraulic fluid of the desired pressure to the operation unit 11*a* of the recovery control valve 11 to control the stroke of the recovery control valve 11 thereby to control the opening (opening area). The regulator 1*a* operates in accordance with a control command from the controller 15 and controls the tilting angle (displacement) of the hydraulic pump 1 to control the delivery flow rate.

Now, an outline of operation when boom lowering and arm driving are performed at the same time is described. It is to be noted that the principle is similar in arm dumping and in arm crowding, and therefore, description is given taking an arm dumping operation as an example.

If the operation lever 5*a* of the first operation unit 5 is operated in the boom lowering direction BD and the operation lever 6*a* of the second operation unit 6 is operated in the arm dumping direction AD at the same time, then the operation pilot pressure Pbd generated from the pilot valve 5*b* of the first operation unit 5 is inputted to the operation unit 3*b* of the control valve 3 and the operation unit 12*a* of the communication pressure increasing valve 12 through the solenoid proportional valve 13. Consequently, the control valve 3 is changed over to a position at the left side in the figure, whereupon the bottom side line 23 is communicated with the tank line 9*b*. Consequently, hydraulic fluid is discharged from the bottom side of the boom cylinder 4 into the tank, and the boom cylinder 4 performs a contraction operation (boom lowering operation). Further, since the communication pressure increasing valve 12 is changed over to a communication position at the lower side in the figure, the bottom side line 23 of the boom cylinder 4 is communicated with the rod side line 24. Consequently, part of discharged fluid at the bottom side of the boom cylinder 4 is supplied to the rod side of the boom cylinder 4 while the pressure at the bottom side of the boom cylinder 4 is increased to approximately two times. Since the meter-out opening area of the control valve 3 is set assuming that the pressure at the bottom side is increased to approximately two times, the boom cylinder 4 can be operated at an operation speed desired by the operator by operating the control valve 3 to perform a changeover operation in response to the operation pilot pressure Pbd to control the meter-out opening (opening area) without the necessity for special control.

The operation pilot pressure Pad generated from the pilot valve 6*b* of the second operation unit 6 is inputted to the operation unit 7*b* of the control valve 7. Consequently, the control valve 7 is changed over to communicate the bottom side line 28 with a tank line 10*b* and communicate the rod side line 29 with the hydraulic fluid supply line 10*a*. Consequently, hydraulic fluid at the bottom side of the arm cylinder 8 is discharged into the tank while delivery fluid from the hydraulic pump 1 is supplied to the rod side of the arm cylinder 8, whereupon the arm cylinder 8 performs a contracting operation.

The detection signal 141 from the pressure sensor 41 that detects the operation pilot pressure Pa of the second operation unit 6 is inputted to the machine controller 42, by which a pump demanded flow rate necessary to drive the arm cylinder 8 is calculated.

To the recovery controller 15, the detection signals 114, 119 and 121 from the pressure sensors 14, 19 and 21 and the pump demanded flow rate signal 104 from the machine controller 42 are inputted. The recovery controller 15 outputs control commands to the solenoid proportional valves 13 and 17 and the regulator 1*a* of the hydraulic pump 1 by control logic hereinafter described.

The solenoid proportional valve 17 generates a control pressure according to the control command, and the recovery control valve 11 is controlled by the control pressure such that part or the entirety of the hydraulic fluid discharged from the bottom side of the boom cylinder 4 is recovered and supplied to the arm cylinder 8 through the recovery control valve 11.

The solenoid proportional valve 13 reduces the operation pilot pressure Pbd of the pilot valve 5*b* in accordance with the control command and controls the opening of the control valve 3 so as to keep the boom cylinder 4 at a target speed.

The regulator 1*a* of the hydraulic pump 1 controls the tilting angle of the hydraulic pump 1 on the basis of the control command to control the pump flow rate appropriately so as to keep a target speed of the arm cylinder 8.

Now, a control function of the recovery controller 15 is described.

The recovery controller 15 generally has the following three functions.

First, when the first operation unit 5 is operated in the boom lowering direction BD that is the own weight falling direction of the boom 205 (first driven member) and the second operation unit 6 is simultaneously operated, if the pressure at the bottom side of the boom cylinder 4 is higher than the pressure in the hydraulic fluid supply line 10*a* between the hydraulic pump 1 and the arm cylinder 8, then the recovery controller 15 opens the recovery control valve 11 to control the flow rate of hydraulic fluid to be supplied from the bottom side of the boom cylinder 4 to the hydraulic fluid supply line 10*a* (first function).

Further, the recovery controller 15 controls the control valve 3 (discharge restrictor valve) on the basis of the operation amount in the boom lowering direction BD of the first operation unit 5, the pressure at the bottom side of the boom cylinder 4 and the pressure in the hydraulic fluid supply line 10*a* between the hydraulic pump 1 and the arm cylinder 8 (calculates a flow rate that is not supplied to any of the rod side of the boom cylinder 4 and the hydraulic fluid supply line 10*a* from within the flow rate discharged from the bottom side of the boom cylinder 4 and returns the calculated flow rate to the tank) (second function).

In this second function, the recovery controller 15 calculates a target bottom flow rate to be discharged from the bottom side of the boom cylinder 4 on the basis of the operation pilot pressure Pbd that is an operation signal in the boom lowering direction BD of the first operation unit 5 and calculates a recoverable flow rate demanded by the control valve 7 of the arm cylinder 8, and sets a lower one of the target bottom flow rate and the recoverable flow rate as a target recovery flow rate. Further, the recovery controller 15 subtracts the target recovery flow rate from the target bottom flow rate to calculate a target discharge flow rate, and controls the recovery control valve 11 such that the flow rate of hydraulic fluid to be recovered to the arm cylinder 8 side becomes coincident with the target recovery flow rate. Further, the recovery controller 15 controls the control valve 3 (discharge restrictor valve) such that the flow rate to be returned to the tank coincides with the target discharge flow rate.

Furthermore, when the recovery control valve 11 is opened to supply hydraulic fluid from the bottom side of the boom cylinder 4 to the hydraulic fluid supply line 10*a* between the hydraulic pump 1 and the arm cylinder 8, the recovery controller 15 controls the displacement of the hydraulic pump 1 so as to be reduced by an amount corresponding to the recovery flow rate to be supplied from the bottom side of the boom cylinder 4 to the hydraulic fluid supply line 10*a* (third function).

Figure 4:
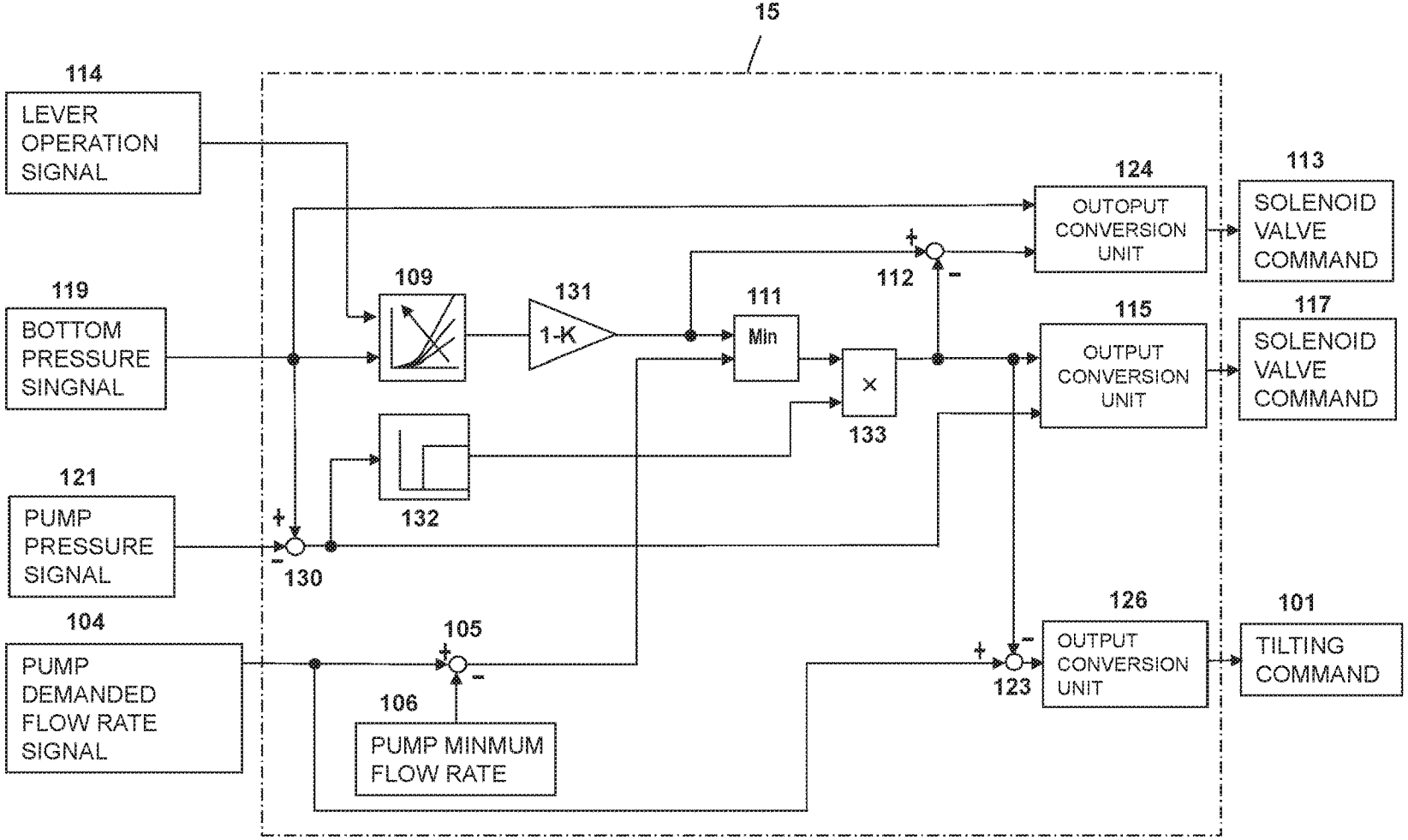
FIG. 4 is a block diagram depicting control logic of a recovery controller in the first embodiment.

FIG. 4 is a block diagram depicting control logic of the recovery controller 15 that executes the three functions described above.

As depicted in FIG. 4, the recovery controller 15 includes an adder 105, a pump minimum flow rate setting unit 106, a function generator 109, a minimum value selector 111, another adder 112, an output conversion unit 115, a further adder 123, another output conversion unit 124, a further output conversion unit 126, a gain generator 131, another function generator 132, an integrator 133 and a still further adder 130.

Referring to FIG. 4, the detection signal 114 is a signal (lever operation signal) indicative of a operation pilot pressure Pbd in the boom lowering direction of the operation lever 5*a* of the first operation unit 5 detected by the pressure sensor 14, and another detection signal 119 is a signal (bottom pressure signal) indicative of a pressure (pressure in the bottom side line 23) at the bottom side of the boom cylinder 4 detected by the pressure sensor 19. A further detection signal 121 is a signal (pump pressure signal) indicative of a delivery pressure of the hydraulic pump 1 (pressure of the hydraulic fluid supply line 10*a*) detected by the pressure sensor 21.

The function generator 109 receives, as inputs thereto, the lever operation signal 114 and the bottom pressure signal 119 and calculates a target bottom flow rate. The calculation characteristic of the target bottom flow rate of the function generator 109 is set such that the target bottom flow rate increases in proportion to the lever operation signal 114 (operation pilot pressure Pbd) and, as the bottom pressure signal 119 (pressure at the bottom side of the boom cylinder 4) increases, the increase rate of the target bottom flow rate to the lever operation signal 114 increases (the inclination becomes steeper).

An output of the function generator 109 is inputted to the gain generator 131. The gain generator 131 calculates the flow rate of hydraulic fluid, from within returning fluid discharged to the bottom side line 23 of the boom cylinder 4, which is not sent to the rod side line 24 but flows to the control valve 3 and/or the recovery control valve 11. By opening the communication pressure increasing valve 12, a flow rate obtained by multiplying a flow rate discharged from the bottom side of the boom cylinder 4 by an area ratio flows to the rod side of the boom cylinder 4. In particular, as described hereinabove, where the pressure receiving area ratio Ar/Ab of the rod side pressure receiving area Ar to the bottom side pressure receiving area Ab of the boom cylinder 4 is represented by k, the gain of the gain generator 131 is given by (1−k).

On the other hand, the pump demanded flow rate signal 104 outputted from the machine controller 42 and the minimum flow rate of the hydraulic pump 1 set in advance to the pump minimum flow rate setting unit 106 are inputted to the adder 105, by which the pump minimum flow rate is subtracted from the pump demanded flow rate to calculate a recoverable flow rate. Here, the hydraulic pump 1 is configured such that, for the object of improvement of the responsiveness upon starting of actuator driving or lubrication security upon actuator non-driving, even when all operation levers are positioned at their neutral position, the hydraulic pump 1 is kept to a minimum tilting angle and delivers a minimum flow rate. The minimum flow rate is set in the pump minimum flow rate setting unit 106.

The target bottom flow rate outputted from the gain generator 131 and the recoverable flow rate outputted form the adder 105 are inputted to the minimum value selector 111, which selects a lower one of the inputted values and outputs the selected value as a target recovery flow rate.

The adder 130 receives, as inputs thereto, the bottom pressure signal 119 and the pump pressure signal 121 and determines a deviation between the bottom pressure signal 119 and the pump pressure signal 121 (differential pressure between the pressure at the bottom side of the boom cylinder 4 and the delivery pressure of the hydraulic pump 1). The deviation (differential pressure) is inputted to the function generator 132. If the deviation (differential pressure) determined by the adder 130 is equal to or higher than a threshold value determined in advance, then the function generator 132 outputs 1 signifying that recovery is possible, but if the deviation (differential pressure) is lower than the threshold value, then the function generator 132 outputs 0 signifying that recovery is impossible. As the threshold value, a rather low value proximate to zero is set in order to make it possible to decide whether or not the pressure at the bottom side of the boom cylinder 4 is higher than the delivery pressure of the hydraulic pump 1 and recovery is possible.

The integrator 133 receives, as inputs thereto, the target recovery flow rate determined by the minimum value selector 111 and an output of the function generator 132. If 1 is outputted from the function generator 132, then the integrator 133 outputs the target recovery flow rate determined by the minimum value selector 111, but if 0 is outputted from the function generator 132, then the integrator 133 outputs the target recovery flow rate of zero.

The deviation (differential pressure) between the bottom pressure signal 119 and the pump pressure signal 121 calculated by the adder 130 and the target recovery flow rate calculated by the integrator 133 are inputted to the output conversion unit 115, by which a target opening area of the recovery control valve 11 is calculated in accordance with an expression of orifice. The target opening area of the recovery control valve 11 is outputted as a solenoid valve command 117 to the solenoid proportional valve 17.

Here, if the delivery pressure of the hydraulic pump 1 is higher than the pressure at the bottom side of the boom cylinder 4 and recovery is impossible, then the function generator 132 outputs 0 and the integrator 133 outputs the target recovery flow rate of zero such that the output conversion unit 115 sends the solenoid valve command 117 to the solenoid proportional valve 17 so as not to operate the recovery control valve 11. On the other hand, when the pressure at the bottom side of the boom cylinder 4 is higher than the delivery pressure of the hydraulic pump 1 and recovery is possible, the function generator 132 outputs 1 and the integrator 133 outputs the target recovery flow rate determined by the minimum value selector 111 such that the output conversion unit 115 sends the solenoid valve command 117 to the solenoid proportional valve 17 to open the recovery control valve 11 thereby to obtain the target recovery flow rate (first function).

The target recovery flow rate calculated by the integrator 133 and the target bottom flow rate outputted from the gain generator 131 are inputted to the adder 112, which subtracts the target recovery flow rate from the target bottom flow rate to calculate a target discharge flow rate. The calculated target discharge flow rate and the bottom pressure signal 119 are inputted to the output conversion unit 124, which calculates a meter-out restrictor opening of the control valve 3 in accordance with the expression of orifice. The calculated meter-out restrictor opening of the control valve 3 is outputted as a solenoid valve command 113 to the solenoid proportional valve 13. Consequently, the control valve 3 (discharge restrictor valve) is controlled such that, from within the flow rate discharged from the bottom side of the boom cylinder 4, the flow rate that is not supplied to any of the rod side of the boom cylinder 4 and the hydraulic fluid supply line 10*a* is returned to the tank (second function).

The pump demanded flow rate signal 104 outputted from the machine controller 42 and the target recovery flow rate calculated by the integrator 133 are inputted to the adder 123, which subtracts the target recovery flow rate from the pump demanded flow rate to calculate a target pump flow rate. The target pump flow rate outputted from the adder 123 is converted by the output conversion unit 126 into and outputted as a tilting command 101 for the hydraulic pump 1 to the regulator 1*a*. Consequently, the hydraulic pump 1 controls such that the displacement thereof is reduced by an amount corresponding to the recovery flow rate supplied from the bottom side of the boom cylinder 4 to the hydraulic fluid supply line 10*a* (third function).

Now, operation of the recovery controller 15 is described.

If the operation lever 5*a* of the first operation unit 5 is operated in the boom lowering direction BD, then a signal of the operation pilot pressure Pbd detected by the pressure sensor 14 is inputted as the lever operation signal 114 to the controller 15. Further, signals of the pressure at the bottom side of the boom cylinder 4 and the delivery pressure of the hydraulic pump 1 detected by the pressure sensors 19 and 21 are inputted as the bottom pressure signal 119 and the pump pressure signal 121 to the recovery controller 15, respectively.

The lever operation signal 114 and the bottom pressure signal 119 are inputted to the function generator 109, by which a target bottom flow rate is calculated, and the flow rates to flow to the control valve 3 and the recovery control valve 11 are calculated by the gain generator 131.

On the other hand, if the operation lever 6*a* of the second operation unit 6 is operated in the arm dumping direction AD, then the signal 141 of the operation pilot pressure Pad detected by the pressure sensor 41 is inputted to the machine controller 42, by which a pump demanded flow rate necessary to drive the arm cylinder 8 is calculated. This pump demanded flow rate is sent as the pump demanded flow rate signal 104 to the recovery controller 15, which subtracts the pump minimum flow rate from the pump demanded flow rate to calculate a recoverable flow rate. The calculated recoverable flow rate and the target bottom flow rate are inputted to the minimum value selector 111, which selects and outputs a lower one of the values as a target recovery flow rate.

The adder 130, function generator 132 and integrator 133 decide whether or not the pressure of the bottom pressure signal 119 (pressure at the bottom side of the boom cylinder 4) is higher than the pressure of the pump pressure signal 121 (delivery pressure of the hydraulic pump 1). If the pressure of the bottom pressure signal 119 is higher (if recovery is possible), then the target recovery flow rate determined by the minimum value selector 111 is outputted, but if the pressure of the pump pressure signal 119 is higher (if recovery is impossible), the target recovery flow rate of 0 is outputted from the integrator 133.

The calculated target recovery flow rate and the bottom pressure signal 119 and pump pressure signal 121 are inputted to the output conversion unit 115, which calculates an opening area of the recovery control valve 11 on the basis of the expression of orifice and outputs the calculated opening area as the solenoid valve command 117 to the solenoid proportional valve 17 (first function).

By this, at least part of hydraulic fluid to be discharged from the boom cylinder 4 is controlled to a flow rate equal to the target through the recovery control valve 11 and is recovered to the arm cylinder 8 side. Then, at this time, since the communication pressure increasing valve 12 is open and the pressure at the bottom side of the boom cylinder 4 has increased to approximately twice, the energy of hydraulic fluid to be recovered from the bottom side of the boom cylinder 4 to the arm cylinder 8 side increases, and further energy saving can be anticipated.

The difference between the target bottom flow rate and the target recovery flow rate is calculated to determine a target discharge flow rate by the adder 112, and the determined target discharge flow rate and the bottom pressure signal 119 are inputted to the output conversion unit 124. The output conversion unit 124 calculates the meter-out opening area of the control valve 3 using the expression of orifice and outputs the calculated meter-out opening area as the solenoid valve command 113 to the solenoid proportional valve 13 (second function).

By this, the control valve 3 is controlled to an appropriate opening, and the target speed of the boom cylinder 4 can be secured while the flow rate is recovered to the arm cylinder 8 side.

Further, the target recovery flow rate is inputted together with the recoverable flow rate to the adder 123, which calculates a target pump flow rate. The calculated target pump flow rate is inputted to the output conversion unit 126, and the tilting angle of the hydraulic pump 1 is controlled (third function).

By this, the arm cylinder 8 is controlled to a desired speed according to an operation signal (operation pilot pressure Pad) of the second operation unit 6, and by reducing the delivery flow rate of the hydraulic pump 1 by an amount corresponding to the recovery flow rate, the fuel cost of the engine for driving the hydraulic pump 1 can be reduced and power saving can be anticipated.

Second Embodiment

Figure 5:
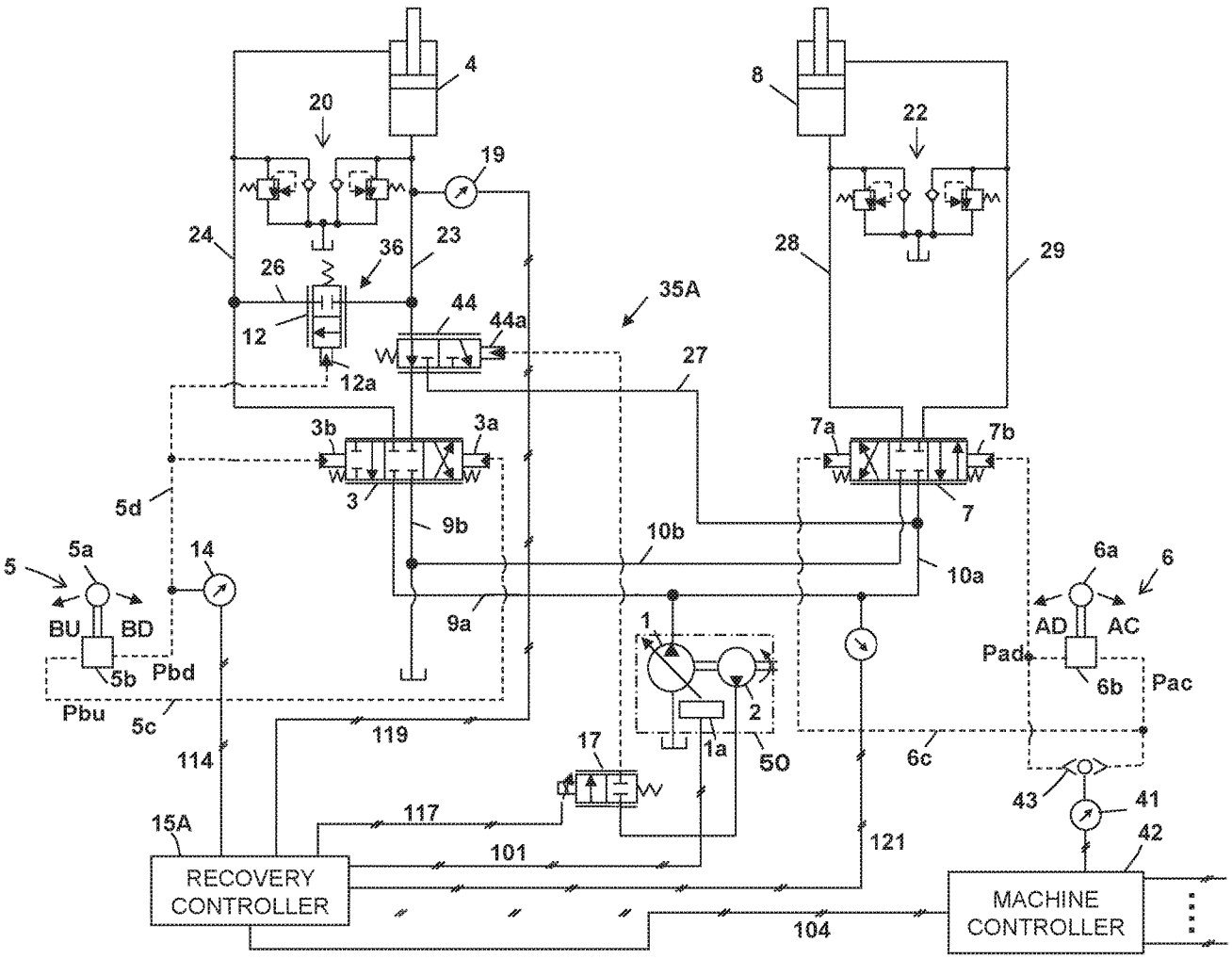
FIG. 5 is a view depicting a hydraulic drive system according to a second embodiment of the present invention.

FIG. 5 is a view depicting a hydraulic drive system according to a second embodiment of the present invention. It is to be noted that description of like elements to those of FIG. 1 is omitted.

Referring to FIG. 5, the hydraulic drive system of the present embodiment includes a recovery circuit 35A having a recovery control valve 44 in place of the recovery control valve 11 in the first embodiment depicted in FIG. 1. The recovery control valve 44 is disposed at a branching portion between the bottom side line 23 and the recovery passage 27 and has a tank side passage (first restrictor) and a recovery side passage (second restrictor) such that discharged fluid from the bottom side of the boom cylinder 4 can be caused to flow to the tank side (control valve 3 side) and the recovery passage 27 side. The stroke of the recovery control valve 44 is controlled by the solenoid proportional valve 17.

Figure 6:
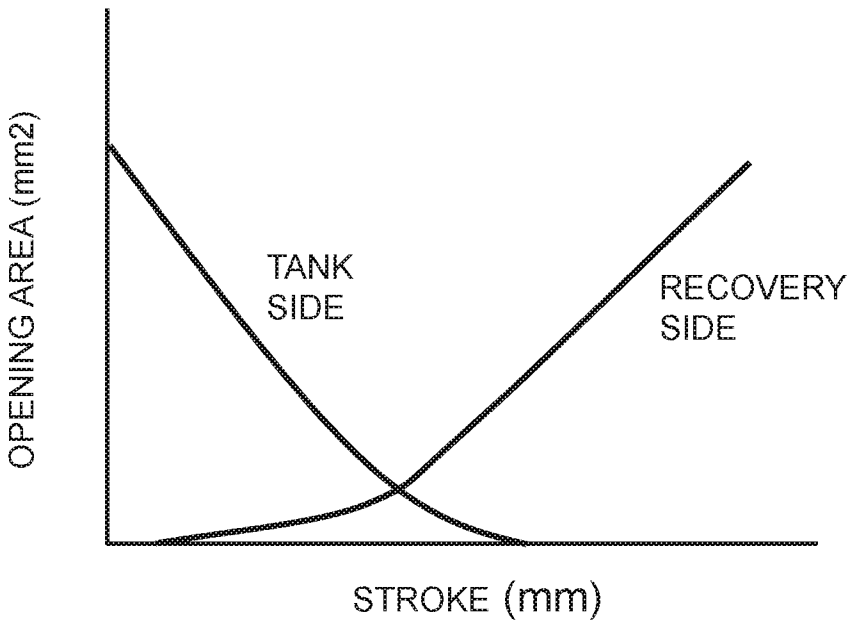
FIG. 6 is a view illustrating an opening area characteristic of a recovery control valve in the second embodiment.

FIG. 6 is a view illustrating an opening area characteristic of the recovery control valve 44. In FIG. 5, the axis of abscissa represents the spool stroke of the recovery control valve 44 and the axis of ordinate represents the opening area of the recovery control valve 44.

Referring to FIG. 6, when the spool stroke is in the minimum (when the recovery control valve 44 is at its normal position), the tank side passage is open and the opening area is in the maximum while the recovery side passage is closed and the opening area is zero. If the stroke is gradually increased, then the opening area of the tank side passage gradually decreases while the recovery side passage is opened and the opening area gradually increases. If the stroke is further increased, then the tank side passage is closed (opening area becomes zero) while the opening area of the recovery side passage further increases. Since the recovery control valve 44 is configured in such a manner as described above, when the spool stroke is in the minimum, hydraulic fluid discharged from the bottom side of the boom cylinder 4 is not recovered but flows in whole quantity into the control valve 3 side. If the stroke is gradually moved to the right, then part of the hydraulic fluid discharged from the bottom side of the boom cylinder 4 flows into the recovery passage 27. Further, by adjusting the stroke, the opening areas of the tank side and recovery side passages can be changed, and the recovery flow rate can be controlled.

In particular, when the lever operation amount of the first operation unit 5 is great, the recovery flow rate is controlled such that much hydraulic fluid flows by increasing the stroke of the recovery control valve 44 to increase the opening area of the recovery side passage. The opening area characteristic of the recovery control valve 44 may be adjusted such that discharged fluid at the bottom side of the boom cylinder 4 at this time becomes equal to that when recovery is not performed.

Subsequently, operation is described.

In boom lowering and arm dumping operations, when the pressure at the bottom side of the boom cylinder 4 is lower than the pressure at the rod side of the arm cylinder 8, if the recovery control valve 44 is positioned at the normal position, then discharged fluid at the bottom side of the boom cylinder 4 is all discharged into the tank through the meter-out passage of the control valve 3. Normal boom lowering operation is performed thereby.

In boom lowering and arm dumping operations, when the pressure at the bottom side of the boom cylinder 4 is higher than the pressure at the rod side of the arm cylinder 8, if the recovery control valve 44 is changed over from the normal position, then the discharged fluid at the bottom side of the boom cylinder 4 is recovered to the rod side of the arm cylinder 8. Consequently, the delivery flow rate of the hydraulic pump 1 is reduced by an amount corresponding to the recovered flow rate. As a result, it is possible to suppress the output power of the hydraulic pump 1 to reduce the fuel cost of the engine that drives the hydraulic pump 1 thereby to achieve energy saving.

It is to be noted that, while, in the present embodiment, the flow rate to be discharged to the tank side and the flow rate to be recovered cannot finely controlled independently of each other as in the case of the first embodiment, only one solenoid valve is necessitated. Therefore, a simplified configuration can be applied, and reduction of the cost can be achieved and also the mountability is improved.

Further, normally boom lowering and arm dumping operations are frequently performed principally in a graveling operation and a leveling operation, and where the pressure at the bottom side of the boom cylinder 4 is higher than the pressure at the rod side of the arm cylinder 8 and recovery is possible, lever operation amounts of the first and second operation unit 5 and 6 are frequently fixed to some degree. From this, by analyzing a gravel loading operation and a leveling operation, it is possible to set an optimum opening area characteristic of the recovery control valve 44, and it is possible to achieve an energy saving effect substantially equal to that in the first embodiment with a simple configuration.

Further, the hydraulic drive system of the present embodiment includes a recovery controller 15A in place of the recovery controller 15 in the first embodiment depicted in FIG. 1.

The controller 15A has the above-described first to third functions the controller 15 has. Further, the controller 15A controls the recovery control valve 44 on the basis of the operation amount of the first operation unit 5 in the boom lowering direction BD, the pressure at the bottom side of the boom cylinder 4 and the pressure in the hydraulic fluid supply line 10*a* between the hydraulic pump 1 and the arm cylinder 8 (fourth function).

Figure 7:
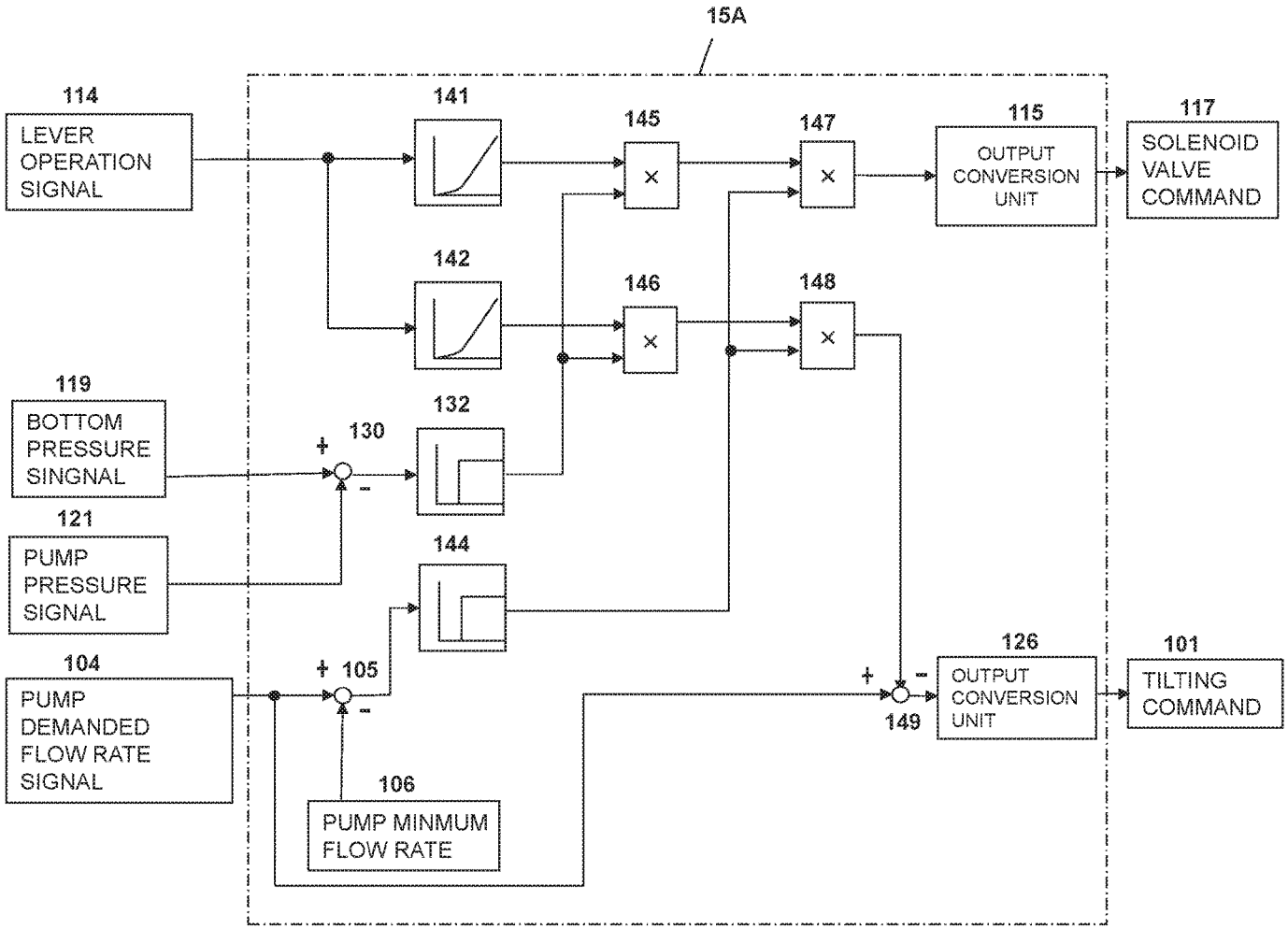
FIG. 7 is a block diagram depicting control logic of a recovery controller in the second embodiment.

FIG. 7 is a block diagram illustrating control logic of the recovery controller 15A in the second embodiment. It is to be noted that description of control elements similar to those in FIG. 2 is omitted.

As depicted in FIG. 7, the recovery controller 15A includes function generators 141, 142 and 144, integrators 145, 146, 147 and 148, and an adder 149 in place of the function generator 109, minimum value selector 111, adder 112, adder 123, output conversion unit 124, gain generator 131 and integrator 133 in the first embodiment of FIG. 4.

The function generator 141 calculates the opening area of the recovery side passage of the recovery control valve 44 in response to the lever operation signal 114 of the first operation unit 5 and has set thereto a characteristic same as the opening area characteristic of the recovery side passage of the recovery control valve 44 depicted in FIG. 6.

The function generator 142 determines a reduction flow rate (hereinafter referred to as pump reduction flow rate) of the hydraulic pump 1 in response to the lever operation amount signal 114. The function generator 142 preferably sets in response to an opening area characteristic set by the function generator 141. In particular, as the opening area calculated by the function generator 141 increases, the recovery flow rate increases, and therefore, it is necessary to set also the pump reduction flow rate to a higher rate in response to the opening area calculated by the function generator 141. In the present embodiment, the function generator 142 has a characteristic set therein which is same as the opening area characteristic of the function generator 141.

As described in the description of the first embodiment, the adder 130 calculates a deviation between the bottom pressure signal 119 and the pump pressure signal 121 (differential pressure between the pressure at the bottom side of the boom cylinder 4 and the delivery pressure of the hydraulic pump 1), and this deviation (differential pressure) is inputted to the function generator 132. If the deviation (differential pressure) determined by the adder 130 is equal to or higher than a threshold value determined in advance, then the function generator 132 outputs 1 that signifies that recovery is possible. However, if the deviation (differential pressure) is lower than the threshold value, then the function generator 132 outputs 0 that signifies that recovery is impossible. As the threshold value, a rather low value proximate to zero is set such that it is made possible to decide whether or not the pressure at the bottom side of the boom cylinder 4 is higher than the delivery pressure of the hydraulic pump 1 and recovery is possible.

The integrator 145 receives, as inputs thereto, an opening area calculated by the function generator 141 and a value calculated by the function generator 132. When the function generator 132 outputs 1 (when the differential pressure is equal to or higher than the threshold value), the integrator 145 decides that recovery is possible and outputs the opening area calculated by the function generator 141. However, when the function generator 132 outputs 0 (when the differential pressure is lower than the threshold value), the integrator 145 decides that recovery is impossible and outputs 0 as the opening area of the recovery side passage.

The integrator 146 receives, as inputs thereof, the pump reduction flow rate calculated by the function generator 142 and a value calculated by the function generator 132. Similarly to the integrator 145, when the function generator 132 outputs 1 (when the differential pressure is equal to or higher than the threshold value), the integrator 146 decides that recovery is possible and outputs the pump reduction flow rate calculated by the function generator 142, but when the function generator 132 outputs 0 (when the differential pressure is lower than the threshold value), the integrator 146 decides that recovery is impossible and outputs 0 as the pump reduction flow rate.

The pump demanded flow rate signal 104 and a minimum flow rate of the hydraulic pump 1 set in advance to the pump minimum flow rate setting unit 106 are inputted to the adder 105, by which a recoverable flow rate is calculated by subtracting the pump minimum flow rate from the pump demanded flow rate.

The recoverable flow rate is inputted to the function generator 144. When the recoverable flow rate is equal to or higher than a threshold value set in advance, the function generator 144 outputs 1 signifying that recovery is possible, but when the recoverable flow rate is lower than the threshold value, the function generator 144 outputs 0 signifying that recovery is impossible. When the recoverable flow rate is low, the meter-in flow opening of the control valve 7 is rather closed, and even if the opening area of the recovery side passage of the recovery control valve 44 is increased, hydraulic fluid little flows to the rod side of the arm cylinder 8. On the contrary, when the recoverable flow rate is sufficiently high, the meter-in opening of the arm cylinder 8 is open and the recovery flow rate can be supplied sufficiently. Therefore, the function generator 144 performs a decision regarding whether or not recovery is possible, and as the threshold value, a rather low value that makes such a decision possible is set.

The integrator 147 receives, as inputs thereto, an output of the integrator 145 and an output of the function generator 144. When the function generator 144 outputs 1, the integrator 147 outputs the output of the function generator 145 (when the function generator 132 outputs 1, an opening area calculated by the function generator 141), but when the function generator 144 outputs 0, the integrator 147 outputs the opening area of zero.

The integrator 148 receives, as inputs thereto, an output of the integrator 146 and an output of the function generator 144. Similarly to the integrator 147, when the function generator 144 outputs 1, the integrator 148 outputs the output of the integrator 146 (when 1 is outputted from the function generator 132, the pump reduction flow rate calculated by the function generator 142), but when 0 is outputted from the function generator 144, the integrator 148 outputs the pump reduction flow rate of zero.

The output of the integrator 147 is inputted to the output conversion unit 115, from which this is outputted as the solenoid valve command 117 to the solenoid proportional valve 17 such that the stoke (opening area) of the recovery control valve 44 is controlled.

The pump demanded flow rate signal 104 outputted from the machine controller 42 and an output of the integrator 148

(pump reduction flow rate) are inputted to the adder 149, by which the pump reduction flow rate is subtracted from the pump demanded flow rate to calculate a target pump flow rate. This target pump flow rate is converted into a tilting command 101 of the hydraulic pump 1 by the output conversion unit 126, and the tilting command 101 is outputted to the regulator 1*a*. Consequently, the hydraulic pump 1 is controlled so as to decrease the displacement thereof by an amount corresponding to the recovery flow rate supplied from the bottom side of the boom cylinder 4 to the hydraulic fluid supply line 10*a*.

When the lever operation signal 114 is inputted by the control logic described above, the opening area of the recovery side passage of the recovery control valve 44 and the pump reduction flow rate are outputted from the function generator 141 and the function generator 142, respectively. Further, a differential pressure between the pressure at the bottom side of the boom cylinder 4 and the delivery pressure of the hydraulic pump 1 is calculated from the bottom pressure signal 119 and the pump pressure signal 121 by the adder 130, and a decision of whether or not recovery is possible is performed by the function generator 132.

Similarly, the pump demanded flow rate signal 104 is inputted to the adder 105, by which the pump minimum flow rate is subtracted from the pump demanded flow rate to calculate a recoverable flow rate, and a decision of whether or not recovery is possible is performed by the function generator 144.

If it is decided in response to the calculated differential pressure and the recoverable flow rate that recovery is possible, then the opening area of the recovery side passage outputted from the function generator 141 is converted into a solenoid valve command 117 by the output conversion unit 115. The solenoid valve command 117 is outputted to the solenoid proportional valve 17 to control the stroke of the recovery control valve 44.

Consequently, the recovery control valve 44 is set to the opening area according to the lever operation signal 114, and discharged fluid at the bottom side of the boom cylinder 4 is recovered to the rod of the arm cylinder 8.

Meanwhile, the pump reduction flow rate outputted from the function generator 142 is calculated as a value obtained by subtracting the pump reduction flow rate from the flow rate of the pump demanded flow rate signal 104 by the adder 149. The calculated value is outputted as a tilting command 101 by the output conversion unit 126.

By this, the hydraulic pump 1 can reduce the delivery flow rate by an amount equal to the recovery flow rate, and it is possible to reduce the fuel cost of the engine for driving the hydraulic pump 1 thereby to achieve energy saving.

Further, in the present embodiment, both of the control for recovering part of the flow rate discharged from the bottom side of the boom cylinder 4 to the arm cylinder 8 side and the control for returning the remaining flow rate to the tank can be performed by a single valve (recovery control valve 44), and only one solenoid valve (solenoid proportional valve 17) is necessitated to electrically control the valve. Therefore, a hydraulic drive system can be implemented with a simple configuration, and reduction of the cost and the mountability can be further improved.

<Others>

Although the embodiments of the present invention are described in the foregoing description, the embodiments of the present invention can be altered in various manners within the spirit of the present invention. For example, while, in the embodiments described hereinabove, the case in which the present invention is applied to a hydraulic excavator is described, the present invention can be applied also to a different work machine such as a hydraulic crane or a wheel loader if it is a work machine that includes a hydraulic cylinder that discharges hydraulic fluid from the bottom side by falling by an own weight of the first driven member and inhales hydraulic fluid from the rod side when the first operation unit is operated in the own weight falling direction of the first driven member.

Further, in the embodiment described hereinabove, a meter-out restrictor of the control valve 3 for the boom is used as a discharge restrictor valve, and from within the flow rate discharged from the bottom side of the boom cylinder 4, the flow rate that is not supplied to any of the rod side of the boom cylinder 4 and the arm cylinder 8 side is returned to the tank. However, a discharge restrictor valve for exclusive use may be provided separately from the control valve 3 such that the flow rate is returned from the discharge restrictor valve to the tank.

Further, in the embodiments described hereinabove, the communication passage 26 is connected between the bottom side line 23 and the rod side line 24, and the communication pressure increasing valve 12 is disposed in the communication passage 26. However, the communication passage 26 may be formed as an internal passage of the control valve 3 and besides the communication pressure increasing valve 12 may be disposed in the control valve 3.

Further, in the embodiments described hereinabove, two controllers including the recovery controller 15 and the machine controller 42 are used. However, the two controllers may be unified into a single controller.

DESCRIPTION OF REFERENCE CHARACTERS

1: Hydraulic pump
2: Pilot pump
3: Control valve
4: Boom cylinder (first hydraulic actuator)
5: First operation unit
5*a*: Operation lever
5*b*: Pilot valve
5*c*, 5*d*: Pilot line
6: First operation unit
6*a*: Operation lever
6*b*: Pilot valve
6*c*, 6*c*: Pilot line
7: Control valve
8: Arm cylinder (second hydraulic actuator)
9*a*, 10*a*: Hydraulic fluid supply line
9*b*, 10*b*: Tank line
11: Recovery control valve
12: Communication pressure increasing valve
13: Solenoid proportional valve
14: Pressure sensor
15, 15A: Recovery controller
16: Solenoid proportional valve
17: Solenoid proportional valve
18: Pressure sensor
19: Pressure sensor
20: Overload relief valve with makeup
21: Pressure sensor
22: Overload relief valve with makeup
23: Bottom side line
24: Rod side line
26: Communication line
27: Recovery line
28: Bottom side line
29: Rod side line

31: Control valve
32: Check valve
35, 35A: Recovery circuit
36: Pressure increasing circuit
41: Pressure sensor
42: Machine controller
43: Shuttle valve
101: Tilting command
104: Pump demanded flow rate signal
105: Adder
106: Pump minimum flow rate setting unit
109: Function generator
111: Minimum value selector
112: Adder
113: Solenoid valve command
114: Lever operation signal
115: Output conversion unit
117: Solenoid valve command
119: Bottom pressure signal
121: Pump pressure signal
123: Adder
124: Output conversion unit
126: Output conversion unit
130: Adder
131: Gain generator
132: Function generator
133: Integrator
141 to 143: Function generator
145 to 148: Integrator
149: Adder
203: Front work implement
205: Boom (first driven member)
206: Arm (second driven member)
207: Bucket

The invention claimed is:

1. A hydraulic drive system for a work machine comprising a hydraulic pump unit, a first hydraulic actuator to which hydraulic fluid is supplied from the hydraulic pump unit to drive a first driven member, a second hydraulic actuator to which hydraulic fluid is supplied from the hydraulic pump unit to drive a second driven member, a first control valve configured to control a flow of hydraulic fluid to be supplied from the hydraulic pump unit to the first hydraulic actuator, a second control valve configured to control a flow of hydraulic fluid to be supplied from the hydraulic pump unit to the second hydraulic actuator, a first operation lever unit configured to output an operation signal for commanding an operation of the first driven member to change over the first control valve, and a second operation lever unit configured to output an operation signal for commanding an operation of the second driven member to change over the second control valve, wherein the first hydraulic actuator is a hydraulic cylinder that discharges, when the first operation lever unit is operated in an own weight falling direction of the first driven member, hydraulic fluid from a bottom side by own weight falling of the first driven member and inhales hydraulic fluid from a rod side, the hydraulic drive system comprising:

a recovery circuit including a recovery passage that connects the bottom side of the hydraulic cylinder to a location between the hydraulic pump unit and the second hydraulic actuator and a recovery control valve that supplies at least part of hydraulic fluid discharged from the bottom side of the hydraulic cylinder to the location between the hydraulic pump unit and the second hydraulic actuator through the recovery passage;

a pressure increasing circuit having a communication passage that connects the bottom side of the hydraulic cylinder to the rod side of the hydraulic cylinder and a communication pressure increasing valve disposed in the communication passage and configured to open in accordance with an operation signal of the first operation lever unit for operating the first driven member in the own weight falling direction to communicate the bottom side with the rod side of the hydraulic cylinder to increase a pressure at the bottom side of the hydraulic cylinder; and a control unit configured to open the recovery control valve, in the case where, when the first operation lever unit is operated in the own weight falling direction of the first driven member and the second operation lever unit is operated at the same time, the pressure at the bottom side of the hydraulic cylinder is higher than a pressure at the location between the hydraulic pump unit and the second hydraulic actuator, to control a flow rate of hydraulic fluid to be supplied from the bottom side of the hydraulic cylinder to the location between the hydraulic pump unit and the second hydraulic actuator;

wherein the first control valve is configured to communicate a meter-out passage to a tank while closing a meter-in passage when the first operation lever unit is operated in the own weight falling direction of the first driven member, the communication pressure increasing valve has a maximum opening area set such that the pressure at the bottom side of the hydraulic cylinder and the pressure at the rod side of the hydraulic cylinder are equal to each other when the communication pressure increasing valve is operated to fully open, and when the first operation lever unit is operated in the own weight falling direction of the first driven member, the first control valve is actuated in a direction to close the meter-in passage while the communication pressure increasing valve is fully opened thereby to increase the pressure at the bottom side of the hydraulic cylinder at a magnification according to a pressure receiving area ratio between the bottom side and the rod side of the hydraulic cylinder.

2. The hydraulic drive system for a work machine according to claim 1, wherein the first control valve functions as a discharge restrictor valve provided between the bottom side of the hydraulic cylinder and a tank, and the control unit is configured to control the discharge restrictor valve based on an operation amount of the first operation lever unit for operating the first driven member in the own weight falling direction, the pressure at the bottom side of the hydraulic cylinder, and the pressure at the location between the hydraulic pump unit and the second hydraulic actuator.

3. The hydraulic drive system for a work machine according to claim 2, wherein the control unit is configured to calculate a target bottom flow rate to be discharged from the bottom side of the hydraulic cylinder and calculates a recoverable flow rate demanded by the second control valve based on an operation signal of the first operation lever unit for operating the first driven member in the own weight falling direction, sets a lower one of the target bottom flow rate and the recoverable flow rate as a target recovery flow rate, subtracts the target recovery flow rate from the target bottom flow rate to calculate a target discharge flow rate, controls the recovery control valve such that a flow rate of hydraulic fluid to be recovered to the second hydraulic actuator side coincides with the target recovery flow rate, and controls the discharge restrictor valve such that a flow rate to be returned to the tank coincides with the target discharge flow rate.

4. The hydraulic drive system for a work machine according to claim 1, wherein the recovery control valve includes a first restrictor configured to control a flow rate of hydraulic fluid to be discharged from the bottom side of the hydraulic cylinder to the tank and a second restrictor configured to control a flow rate of hydraulic fluid to be supplied from the bottom side of the hydraulic cylinder to the location between the hydraulic pump unit and the second hydraulic actuator, and the control unit is configured to control the recovery control valve based on the operation amount of the first operation lever unit for operating the first driven member in the own weight falling direction, the pressure at the bottom side of the hydraulic cylinder and the pressure at the location between the hydraulic pump unit and the second hydraulic actuator.

5. The hydraulic drive system for a work machine according to claim 1, wherein the hydraulic pump unit includes at least one variable displacement hydraulic pump, and the control unit is configured to control, when the recovery control valve is to be opened to supply hydraulic fluid from the bottom side of the hydraulic cylinder to the location between the hydraulic pump and the second hydraulic actuator, such that the displacement of the hydraulic pump is decreased by an amount corresponding to the recovery flow rate to be supplied from the bottom side of the hydraulic cylinder to the location between the hydraulic pump and the second hydraulic actuator.

* * * * *